US010591845B1

(12) United States Patent
Kuramashi

(10) Patent No.: US 10,591,845 B1
(45) Date of Patent: Mar. 17, 2020

(54) DEVELOPING DEVICE AND IMAGE FORMING APPARATUS THEREWITH

(71) Applicant: KYOCERA Document Solutions Inc., Osaka (JP)

(72) Inventor: Koji Kuramashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/534,682

(22) Filed: Aug. 7, 2019

(30) Foreign Application Priority Data

Oct. 3, 2018 (JP) ..... 2018-188491

(51) Int. Cl.
*G03G 15/08* (2006.01)
*G03G 15/09* (2006.01)

(52) U.S. Cl.
CPC ..... *G03G 15/0812* (2013.01); *G03G 15/081* (2013.01); *G03G 15/0914* (2013.01); *G03G 15/0935* (2013.01)

(58) Field of Classification Search
CPC ..... G03G 15/0812; G03G 15/0921; G03G 15/0808; G03G 15/081
See application file for complete search history.

(56) References Cited

U.S. PATENT DOCUMENTS 5,998,080 A 12/1999 Ohno et al. ..... 430/110
2013/0202330 A1* 8/2013 Ochi ..... G03G 15/0896 399/269
2015/0086247 A1* 3/2015 Yoshimoto ..... G03G 15/0921 399/277

FOREIGN PATENT DOCUMENTS

JP 2005-49574 A 2/2005
JP 2006-268056 A 10/2006
JP 2006-284814 A 10/2006
JP 2008-164916 A 7/2008

* cited by examiner

*Primary Examiner* — Walter L Lindsay, Jr.
*Assistant Examiner* — Jessica L Eley
(74) *Attorney, Agent, or Firm* — Stein IP, LLC

(57) ABSTRACT

A developing device has a housing, a developer carrying member, a regulating blade, and a magnetic member. The regulating blade forms a regulating portion regulating the thickness of toner carried on the developer carrying member. The magnetic member is arranged inside the developer carrying member and has a plurality of magnetic poles including a regulating pole arranged at a position where the developer carrying member and the regulating blade are close together. The regulating pole is movable to a first position facing the regulating portion and to a second position rotated to the upstream side from the first position in the rotation direction of the developer carrying member during image formation. The developing device is operable in the developer removing mode in which, when no image is formed, the regulating pole is moved from the first position to the second position and is then returned to the first position.

11 Claims, 7 Drawing Sheets

DEVELOPING DEVICE AND IMAGE FORMING APPARATUS THEREWITH

INCORPORATION BY REFERENCE

This application is based upon and claims the benefit of priority from the corresponding Japanese Patent Application No. 2018-188491 filed on Oct. 3, 2018, the entire contents of which are incorporated herein by reference.

BACKGROUND

The present disclosure relates to a developing device incorporated in an image forming apparatus such as copies, printers, and facsimile machines. In particular, the present disclosure relates to a method for preventing developer from clogging in a gap between a developing roller and a regulating blade.

In one conventionally common process as an image developing method in image forming apparatuses using an electro-photographic process, powder developer is mainly used, an electrostatic latent image formed on an image carrying member such as a photosensitive drum is made visible with the developer, and the visible image (toner image) is transferred to a recording medium and is then fixed.

Developer is roughly divided into two-component developer containing toner and magnetic carrier and one-component developer containing non-magnetic or magnetic toner alone. As a developing method using magnetic one-component developer, a so-called jumping one-component developing method is known, according to which a fixed magnet member having a plurality of magnetic poles is arranged inside a developing roller, toner in a developer container is carried on the developing roller by use of a magnetic carrying force, a thin layer of toner is formed through layer thickness regulation by use of a regulating blade, and toner is made to fly to a photosensitive drum at a developing position.

In recent years, low-melting-point toner is increasingly used for energy saving and acceleration of printing. When continuous printing is performed in a high-temperature environment by use of low-melting-point toner, toner stagnating at a place where the developing roller and the regulating blade face each other (regulating portion) softens due to heat or mechanical stress and causes blocking, resulting in clogging in a gap in the regulating portion. This inconveniently results in unevenness in a toner layer on the developing roller, producing vertical streaks such as white streaks and gray streaks on the output image.

To avoid that, for example, toner and a developing system excellent in low-temperature fixability, high-temperature-resistant offset property, and blocking resistance have been developed. According to one known method, the regulating height of the regulating blade in opposite end parts thereof facing near opposite end parts of the developing roller is set higher than in other parts, and thereby compression (high density) of developer in the opposite end parts of the developing roller is reduced, in order to thereby prevent developer agglomeration.

According to another known method, the angle of arrangement of a magnetic field generating means having a plurality of magnetic poles arranged inside the developer carrying member is changed according to the use environment of and the manner of use of the image forming apparatus, in order to thereby improve degraded image quality resulting from lowered image density and fogging due to a white part.

SUMMARY

According to one aspect of the present disclosure, a developing device includes a housing, a developer carrying member, a regulating blade, and a magnetic member. The developing device develops an electrostatic latent image formed on an image carrying member. The housing stores magnetic developer. The developer carrying member is rotatably supported on the housing and carries the developer on the circumferential face. The regulating blade is formed of a magnetic material, is arranged at a predetermined interval from the developer carrying member, and forms a regulating portion that regulates the thickness of the developer carried on the developer carrying member. The magnetic member is arranged inside the developer carrying member and has a plurality of magnetic poles including a regulating pole arranged at a position where the developer carrying member and the regulating blade are close together. The regulating pole is movable to a first position that faces the regulating portion and to a second position rotated to the upstream side through a predetermined angle from the first position with respect to the rotation direction of the developer carrying member during image formation. The developing device is operable in a developer removing mode in which, when no image is formed, the regulating pole is moved from the first position to the second position and is then returned to the first position to remove the developer stagnating in the regulating portion.

Further features and advantages of the present disclosure will become apparent from the description of embodiments given below.

DETAILED DESCRIPTION

Figure 1:
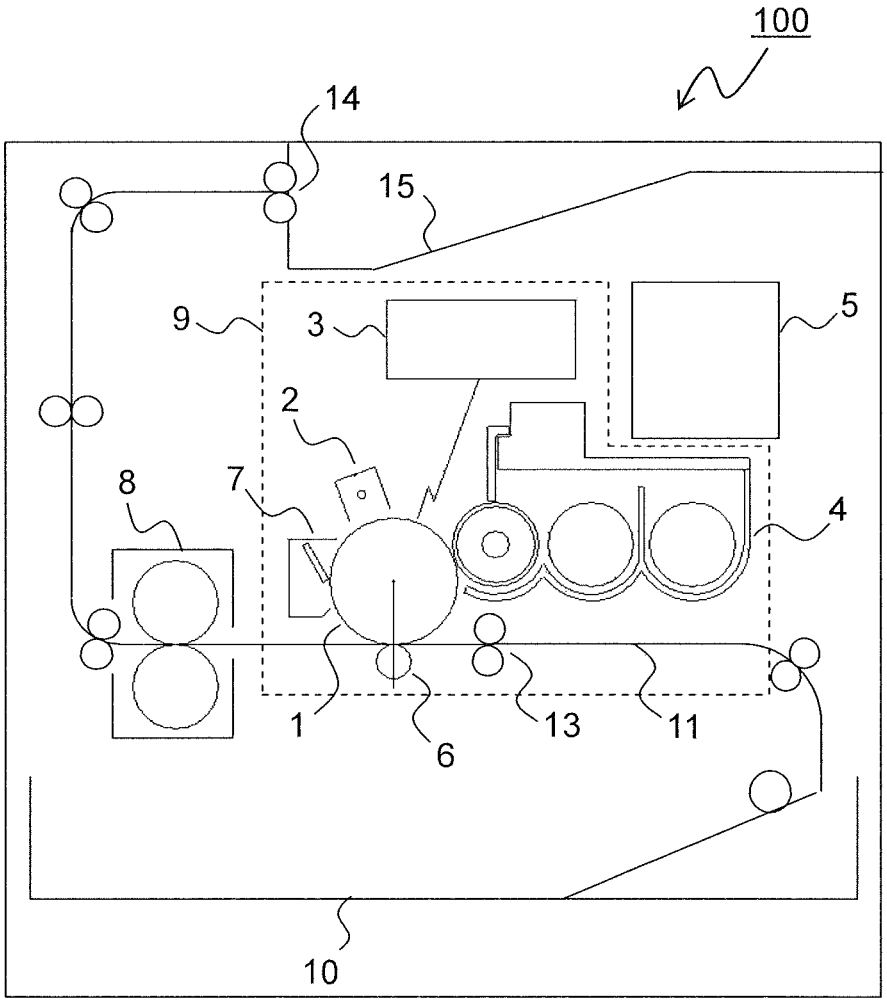
FIG. 1 is a schematic sectional view of an image forming apparatus incorporating a developing device according to one embodiment of the present disclosure.

Hereinafter, with reference to the accompanying drawings, embodiments of the present disclosure will be described. FIG. 1 is a schematic sectional view of an image forming apparatus 100 incorporating a developing device 4 according to one embodiment of the present disclosure. In the image forming apparatus (for example, a monochrome printer) 100, when printing operation is performed, in an image forming portion 9 in the image forming apparatus 100, an electrostatic latent image based on document image data transmitted from a host device (unillustrated) such as a personal computer (hereinafter, referred to as a PC) is formed, and toner is attached to the electrostatic latent image by the developing device 4, so that a toner image is formed. The toner is fed to the developing device 4 from a toner container 5. In the image forming apparatus 100, an image forming process is performed with respect to the photosensitive drum 1 while it is rotated in the clockwise direction in FIG. 1.

In the image forming portion 9, along the rotation direction (the clockwise direction) of the photosensitive drum 1, there are arranged a charging device 2, an exposure unit 3, a developing device 4, a transfer roller 6, a cleaning device 7, and a static eliminator (unillustrated). The photosensitive drum 1 is, for example, an aluminum drum laid with a photosensitive layer, and its surface is electrostatically charged uniformly by the charging device 2. Then, on the surface irradiated with a laser beam from the exposure unit 3, which will be described later, an electrostatic latent image with attenuated electrostatic charge is formed. There is no particular restriction on the photosensitive layer, which preferably is, for example, a layer of amorphous silicon (a-Si), which excels in durability, or the like.

The charging device 2 electrostatically charges the surface of the photosensitive drum 1 uniformly. As the charging device 2, for example, a corona discharge device is used which causes electric discharge by applying a high voltage to a thin wire or the like acting as an electrode. Usable instead of the corona discharge device is a contact-type charging device which applies a voltage while keeping the surface of the photosensitive drum 1 in contact with a charging member as exemplified by a charging roller. The exposure unit 3 irradiates the photosensitive drum 1 with a light beam (for example, a laser beam) based on image data to form an electrostatic latent image on the surface of the photosensitive drum 1.

The developing device 4 forms a toner image by attaching toner to the electrostatic latent image on the photosensitive drum 1. In this embodiment, magnetic one-component developer (hereinafter, referred to as toner) comprising magnetic toner is stored in the developing device 4. The developing device 4 will be described in detail later. The cleaning device 7 includes a cleaning roller, a cleaning blade, or the like that makes line contact with the photosensitive drum 1 in its longitudinal direction (the direction perpendicular to the plane of FIG. 1). After the toner image is moved (transferred) to a sheet, the cleaning device 7 removes toner that remains on the surface of the photosensitive drum 1.

Toward the photosensitive drum 1 having the toner image formed on it as described above, a sheet is conveyed from a sheet storage portion 10 via a sheet conveying passage 11 and a registration roller pair 13 to, with a predetermined timing, the image forming portion 9. The transfer roller 6 moves (transfers), without disturbing, the toner image formed on the surface of the photosensitive drum 1 to a sheet conveyed through the sheet conveying passage 11. Thereafter, in preparation for subsequent formation of new electrostatic latent images, toner left unused on the surface of the photosensitive drum 1 is removed by the cleaning device 7, and electric charge remaining is removed by the static eliminator.

The sheet having the toner image transferred to it is separated from the photosensitive drum 1, and is conveyed to a fixing device 8, where the toner image is heated and pressed so as to be thereby fixed to a sheet. The sheet having passed through the fixing device 8 passed through a discharge roller pair 14 and is discharged onto a sheet discharge portion 15.

Figure 2A:
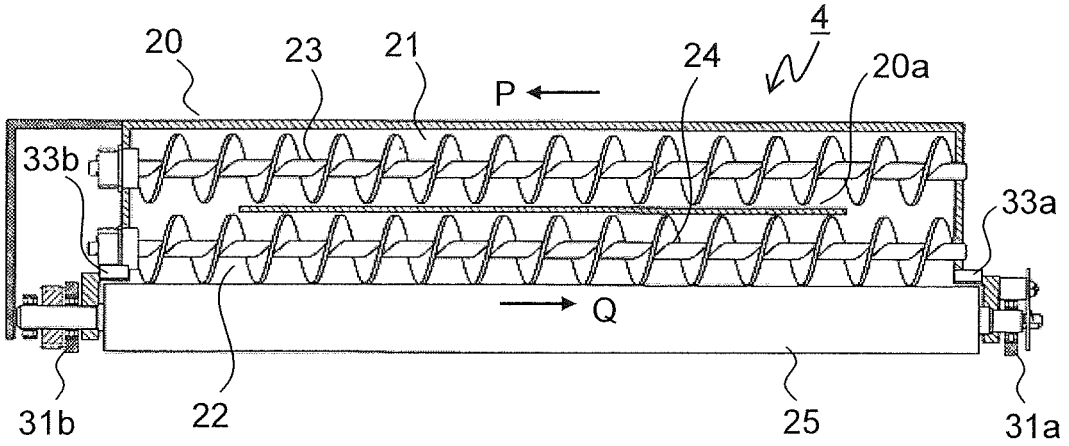
FIG. 2A is a plan view of the developing device according to a first embodiment of the present disclosure.
Figure 2B:
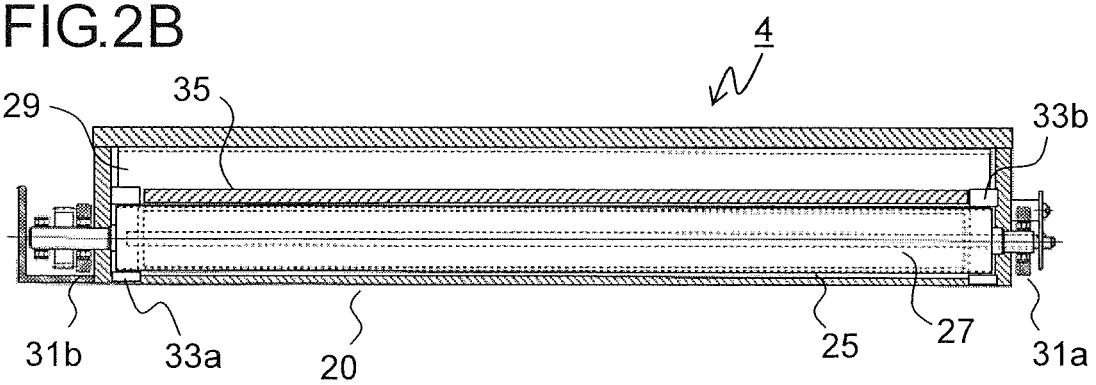
FIG. 2B is a front view of the developing device according to the first embodiment of the present disclosure.
Figure 3:
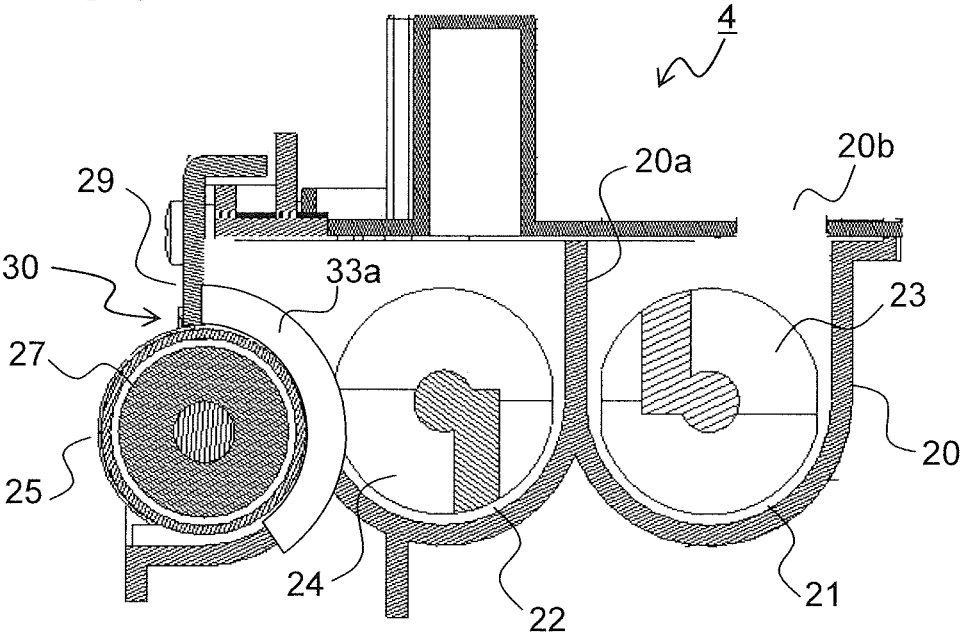
FIG. 3 is a side sectional view of the developing device according to the first embodiment.

FIGS. 2A and 2B are a plan view and a front view, respectively, of the developing device 4 according to a first embodiment of the present disclosure. FIG. 3 is a side sectional view of the developing device 4 according to the first embodiment. In FIG. 2A, for the sake of convenience, the top cover is removed so that the interior is visible. As shown in FIGS. 2 and 3, the interior of a housing 20 is divided into first and second storage chambers 21 and 22 by a partition wall 20*a* formed integrally with the housing 20. In the first and second storage chambers 21 and 22, first and second stirring screws 23 and 24 are arranged, respectively.

The first and second stirring screws 23 and 24 are each composed of a helical blade arranged around a support shaft (rotary shaft) and are rotatably supported on the housing 20 so as to be parallel to each other. As shown in FIG. 2A, there is no partition wall 20*a* in opposite end parts of the housing 20 in its longitudinal direction, which is the axial direction of the first and second stirring screws 23 and 24, so that toner can be moved between the first and second stirring screws 23 and 24. Thus, the first stirring screw 23, while stirring, conveys toner in the first storage chamber 21 in the direction indicated by arrow P to convey it to the second storage chamber 22, and the second stirring screw 24, while stirring, conveys the toner conveyed to the second storage chamber 22 in the direction indicated by arrow Q to feed it to a developing roller 25.

The developing roller 25 rotates as the photosensitive drum 1 (see FIG. 1) rotates, and thereby feeds toner to the photosensitive layer of the photosensitive drum 1. Inside the developing roller 25, a fixed magnet member 27 is fixed which comprises a permanent magnet having a plurality of magnetic poles. By the magnetic force of the fixed magnet member 27, toner is attached to (carried on) the surface of the developing roller 25 to form a magnetic brush. The developing roller 25 is rotatably supported on the housing 20 so as to be parallel to the first and second stirring screws 23 and 24.

A regulating blade 29 is formed so as to be, in its longitudinal direction (in FIG. 2, the left-right direction), larger than the maximum developing width and is arranged at a predetermined interval from the developing roller 25; thus, it forms a regulating portion 30 that regulates the amount of toner (the thickness of the toner layer) to be fed to the photosensitive drum 1. As the material of the regulating blade 29, a magnetic member of SUS (stainless steel) or the like is used.

The bottom face of the second storage chamber 22 facing the second stirring screw 24 is provided with a toner amount detection sensor (unillustrated) that detects the amount of toner stored in the housing 20. According to the result of detection by the toner amount detection sensor, the toner stored in the toner container 5 (see FIG. 1) is fed through a developer feed port 20*b* provided in an upper part of the housing 20 into the housing 20.

DS rollers 31*a* and 31*b* are rotatably fitted outside the rotary shaft of the developing roller 25. The DS rollers 31*a* and 31*b* make contact with opposite end parts, in the axial direction, of the circumferential face of the photosensitive drum 1, and thereby precisely regulate the distance between the developing roller 25 and the photosensitive drum 1. The DS rollers 31*a* and 31*b* each incorporate a bearing and rotate by following the photosensitive drum 1 as it rotates; this helps prevent its surface from wearing. At opposite end parts of the developing roller 25 in the axial direction, magnetic sealing members 33*a* and 33*b* are arranged for preventing toner from leaking through a gap between the housing 20 and the developing roller 25.

Figure 4:
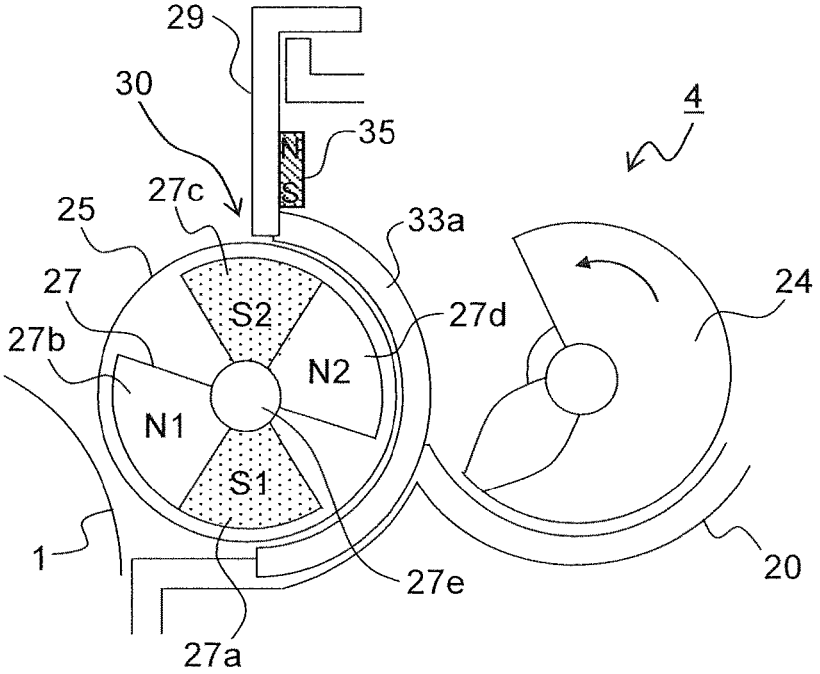
FIG. 4 is an enlarged view of and around a developing roller in the developing device according to the first embodiment.
Figure 5:
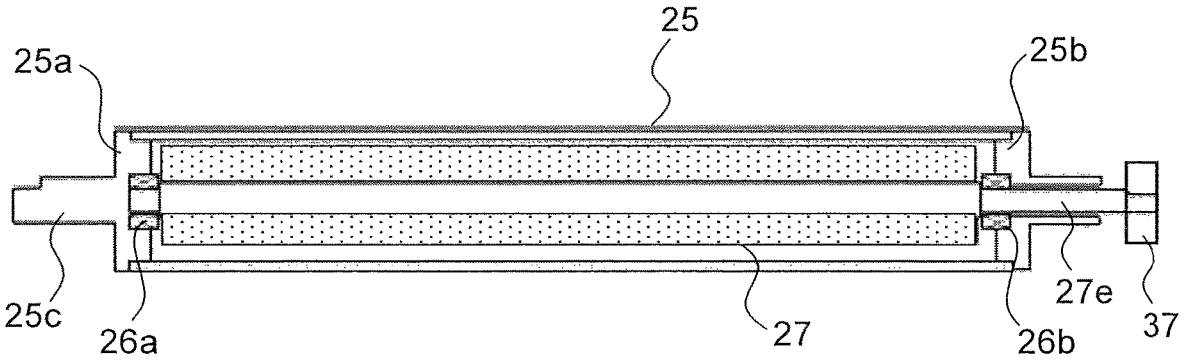
FIG. 5 is a sectional view of the developing roller shown in FIG. 4 as seen from the direction perpendicular to the axial direction.

FIG. 4 is an enlarged view of and around the developing roller 25 in the developing device 4 according to the first embodiment. FIG. 5 is a sectional view of the developing roller 25 shown in FIG. 4 as seen from the direction perpendicular to the axial direction. As shown in FIG. 4, the fixed magnet member 27 has four magnetic poles 27*a* to 27*d*, namely an S1 pole 27*a*, an S2 pole 27*c*, an N1 pole 27*b*, and an N2 pole 27*d*, fixed to a metal shaft 27*e*.

As shown in FIG. 5, to opposite end parts of the developing roller 25 in its longitudinal direction, flange parts 25*a* and 25*b* are fitted respectively, and to the flange part 25*a*, a driving input shaft 25*c* is fixed. One end (in FIG. 5, the right end) of the shaft 27*e* of the fixed magnet member 27 is fixed to the housing 20 (see FIG. 3), and between the flange parts 25*a* and 25*b* and the shaft 27*e*, bearings 26*a* and 26*b* are arranged, respectively. When a rotation driving force is fed from a developing drive motor 41 (see FIG. 6) via a driving input gear (unillustrated) to the driving input shaft 25*c*, the developing roller 25 rotates together with the flange parts 25*a* and 25*b*, whereas the fixed magnet member 27 does not rotates.

To one end of the shaft 27*e*, the driving input gear 37 is fixed, and to the driving input gear 37, a magnet drive motor 43 (see FIG. 6) is connected.

Back in FIG. 4, near the tip end of the regulating blade 29, a blade magnet 35 is provided. As shown in FIG. 2, the blade magnet 35 is provided across substantially the whole length of the regulating blade 29 in its longitudinal direction (in FIG. 2, the left-right direction) between the magnetic sealing members 33*a* and 33*b*. The blade magnet 35 with its S pole down is in contact with the regulating blade 29, and at the tip end of the regulating blade 29, an N pole is induced. Thus, a magnetic field is produced in the regulating portion 30, in the direction attracting between the regulating blade 29 and the S2 pole (regulating pole) 27*c* of the fixed magnet member 27. The position of the S2 pole (regulating pole) 27*c* during image formation shown in FIG. 4 is taken as a first position.

By the magnetic field, a magnetic brush composed of chains of toner particles is formed between the regulating blade 29 and the developing roller 25, and when the magnetic brush passes through the regulating portion 30, its layer is regulated to a desired height. On the other hand, the toner left unused in forming the magnetic brush stagnates along a side face of the regulating blade 29 on its upstream side (right side). Then, when the developing roller 25 rotates in the counter-clockwise direction and the magnetic brush moves to a region (developing region) facing the photosensitive drum 1, a magnetic field is applied by the N1 pole (main pole) 27*b* to the magnetic brush; thus, the magnetic brush makes contact with the surface of the photosensitive drum 1 and develops an electrostatic latent image.

When the developing roller 25 rotates further in the counter-clockwise direction, a magnetic field is applied by the S1 pole (conveying pole) 27*a* now in the direction along the circumferential face of the developing roller 25; thus, the toner left unused in forming the magnetic brush is, together with the magnetic brush, collected on the developing roller 25. Then, the magnetic brush is separated from the developing roller 25 in a hollow part between the S1 pole 27*a* and the N2 pole 27*d*, and falls into the housing 20. Then, after being stirred and conveyed by the second stirring screw 24, a magnetic brush is again formed on the developing roller 25 by the magnetic field from the N2 pole (draw-up pole) 27*d*.

In the housing 20 surrounding the opposite end parts of the developing roller 25, the magnetic sealing members 33*a* and 33*b* are arranged, respectively. In FIG. 4, only the magnetic sealing member 33*a* is illustrated. The magnetic sealing members 33*a* and 33*b* are, as shown in FIG. 4, arranged at the opposite end parts of the developing roller 25 in a non-contact state with the developing roller 25, that is, with a predetermined interval (gap) from the circumferential face of the developing roller 25. The magnetic sealing members 33*a* and 33*b* are arranged opposite from the photosensitive drum 1 across the developing roller 25.

Figure 6:
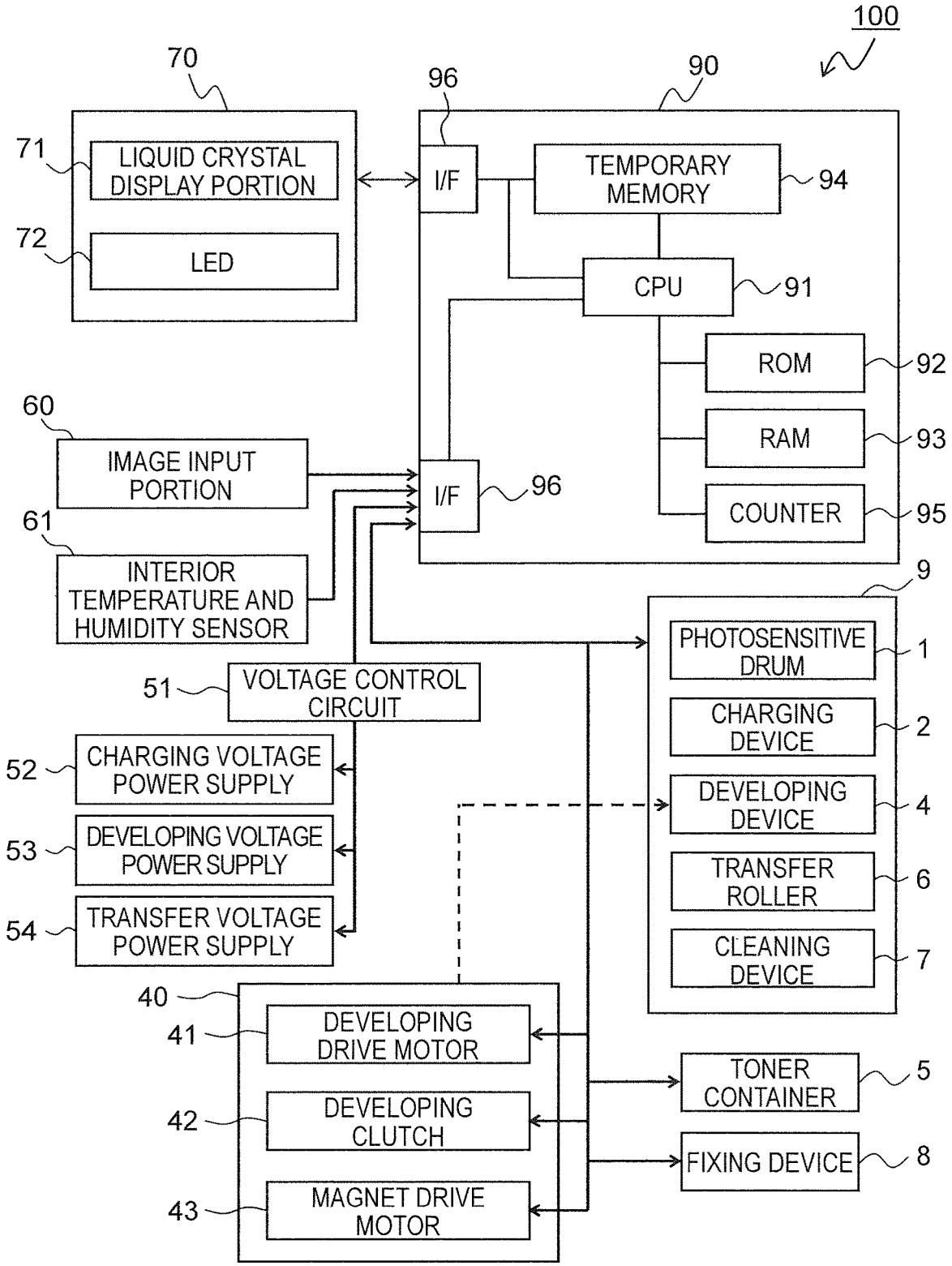
FIG. 6 is a block diagram showing an example of control paths used in the image forming apparatus.

FIG. 6 is a block diagram showing an example of control paths used in the image forming apparatus 100. During the use of the image forming apparatus 100, different blocks in it are controlled in various manners, and this complicates the control paths in the entire image forming apparatus 100. Thus, the following description focuses only on those controlling paths that are relevant to carry out the present disclosure.

A developing drive part 40 includes a developing drive motor 41, a developing clutch 42, and a magnet drive motor 43. The developing drive motor 41 drives the first and second stirring screws 23 and 24 and the developing roller 25 to rotate. The developing clutch 42 turns on and off the rotation driving force that is fed from the developing drive motor 41 to the first and second stirring screws 23 and 24 and the developing roller 25. By rotating the shaft 27*e*, the magnet drive motor 43 rotates the fixed magnet member 27 fixed on the shaft 27*e* through a predetermined angle.

A voltage control circuit 51 is connected to a charging voltage power supply 52, a developing voltage power supply 53, and a transfer voltage power supply 54, and operates those power supplies according to output signals from a control portion 90. Those power supplies operate according to control signals from the voltage control circuit 51 such that predetermined voltages are applied from the charging voltage power supply 52 to a wire in the charging devices 2, from the developing voltage power supply 53 to the developing roller 25 in the developing device 4, and from the transfer voltage power supply 54 to the transfer roller 6.

An image input portion 60 is a receiving portion which receives image data transmitted from a PC or the like to the image forming apparatus 100. The image signal fed from the image input portion 60 is converted into a digital signal, and is then fed out to a temporary memory 94.

An interior temperature and humidity sensor 61 serves to sense the temperature and humidity inside the image forming apparatus 100, in particular, the temperature and humidity of and around the developing device 4, and is arranged near the image forming portion 9.

An operation portion 70 includes a liquid crystal display portion 71 and an LED 72 which indicates various statuses. The operation portion 70 indicates the status of the image forming apparatus 100, and displays the progress of image formation and the number of copies printed. Various settings for the image forming apparatus 100 are made via the printer driver on a PC.

The control portion 90 includes at least a CPU (central processing unit) 91 as a central processor device, a ROM (read-only memory) 92 which is a memory for reading only, a RAM (random-access memory) 93 which is a memory for both reading and writing, a temporary memory 94 which temporarily stores image data and the like, a counter 95, and a plurality of (here, two) I/Fs (interfaces) 96 which transmit control signals to different blocks in the image forming apparatus 100 and which receive input signals from the operation portion 70.

The ROM 92 stores data and the like which are not changed during the use of the image forming apparatus 100, such as a program for control of the image forming apparatus 100 and values necessary for control. The RAM 93 stores necessary data generated in the process of controlling the image forming apparatus 100, data temporarily needed to control the image forming apparatus 100, and the like. The RAM 93 (or the ROM 92) also stores a table that defines a relationship of the temperature and humidity detected by the interior temperature and humidity sensor 61 and the cumulative number of printed sheets counted by the counter 95 with respect to the rotation angle of the fixed magnet member 27, which will be described later.

The temporary memory 94 temporarily stores an image signal which is fed from the image input portion 60 receiving image data transmitted from a PC or the like and which is then converted into a digital signal. The counter 95 counts the number of printed sheets on a cumulative basis.

The control portion 90 transmits control signals from the CPU 91 via the I/Fs 96 to different blocks and devices in the image forming apparatus 100. From the different blocks and devices, signals showing their status and input signals are transmitted via the I/Fs 96 to the CPU 91. The different blocks and devices controlled by the control portion 90 include, for example, the fixing device 8, the image forming portion 9, the developing drive part 40, the voltage control circuit 51, the image input portion 60, and the operation portion 70.

As described earlier, when continuous printing is performed in a high-temperature environment by use of low-melting-point toner as magnetic one-component developer, toner stagnating in the regulating portion 30 in the developing device 4 softens and causes blocking (agglomeration), resulting in clogging. As a remedy, in this embodiment, the developing device 4 can operate in a developer removing mode in which, when no image is formed, the fixed magnet member 27 inside the developing roller 25 is rotated through a predetermined angle to remove the toner (developer) stagnating in the regulating portion 30.

Figure 7:
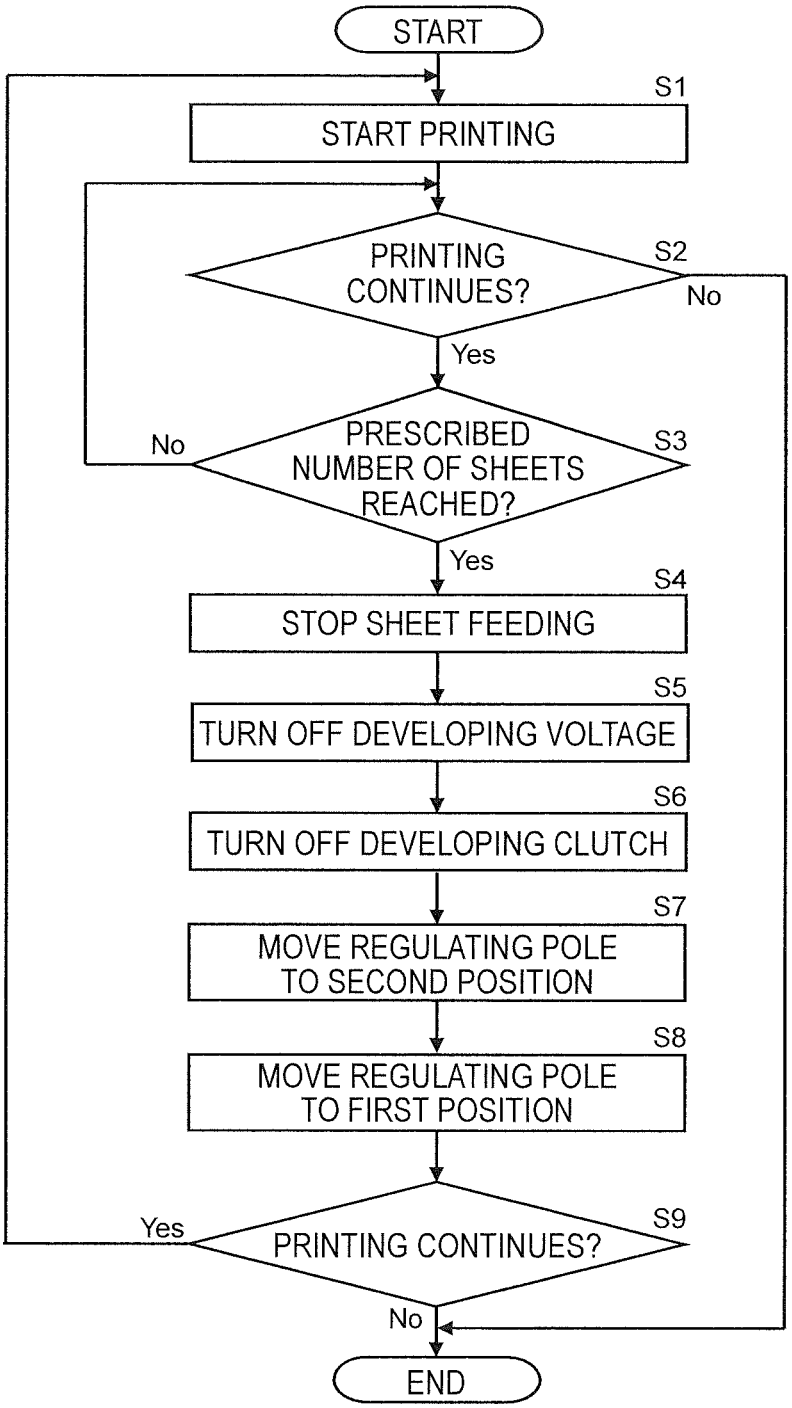
FIG. 7 is a flow chart showing an example of control in a developer removing mode in the developing device according to the first embodiment.

FIG. 7 is a flow chart showing an example of control in the developer removing mode in the developing device 4 according to the first embodiment. With reference to FIGS. 1 to 6 as necessary, a procedure for executing the developer removing mode will be described along the steps in FIG. 7.

When a print instruction is fed in from a host device such as a PC and printing is started (step S1), the control portion 90 (see FIG. 6) checks whether or not printing continues (step S2). If printing continues, then, the control portion 90 checks whether or not the cumulative number of printed sheets counted after the previous execution of the developer removing mode has reached the prescribed number of sheets (step S3). If the cumulative number of printed sheets has not reached the prescribed number of sheets (step S3, No), the flow returns to step S2, where printing is continued. If printing is finished before the cumulative number of printed sheets has reached the prescribed number of sheets (step S2, No), the procedure ends.

If the cumulative number of printed sheets has reached the prescribed number of sheets (step S3, Yes), in response to a control signal from the control portion 90, sheets stop being fed from the sheet storage portion 10 (step S4). Also, the developing voltage stops being applied from the developing voltage power supply 53 (see FIG. 6) to the developing roller 25 (step S5) and the developing clutch 42 is turned off (see FIG. 6) (step S6), thus stopping the rotation of the developing roller 25.

Then, a control signal is fed from the control portion 90 to the magnet drive motor 43 (see FIG. 6) so that the fixed magnet member 27 is rotated through a predetermined angle in the backward direction (in FIG. 4, the clockwise direction) with respect to the rotation direction (the forward direction) of the developing roller 25 during image formation, thereby to move the S2 pole (regulating pole) 27*c* to a position (hereinafter, referred to as a second position) rotated in the backward direction through the predetermined angle from the first position (see FIG. 4) (step S7).

Figure 8:
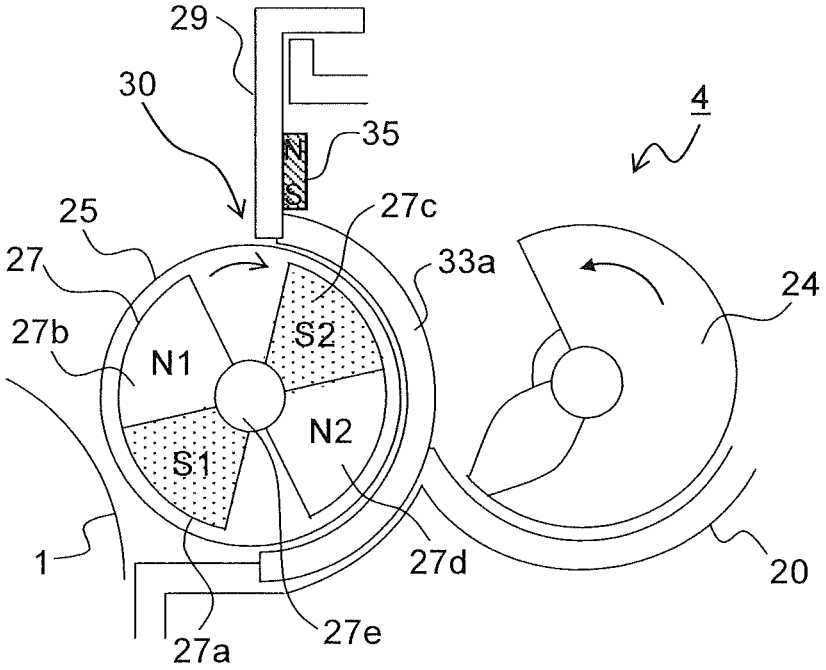
FIG. 8 is an enlarged view of and around the developing roller in the developing device, showing a state where a S2 pole of a fixed magnet member has been moved from a first position to a second position.
Figure 9:
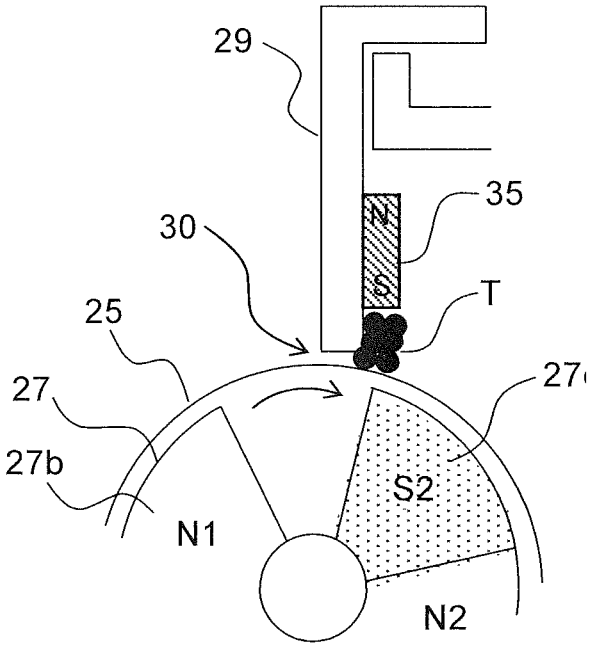
FIG. 9 is a partly enlarged view around a regulating portion in FIG. 8.

FIG. 8 is an enlarged view of and around the developing roller 25 in the developing device 4, showing a state where the S2 pole 27*c* of the fixed magnet member 27 has been moved from the first position to the second position. FIG. 9 is a partly enlarged view around the regulating portion 30 in FIG. 8. Toner carried on the circumferential face of the developing roller 25 during image formation moves together with the developing roller 25 rotating in the counter-clockwise direction in FIG. 9, and then enters the regulating portion 30 from the upstream side (in FIG. 9, the right side) of the regulating blade 29.

Thus, as shown in FIG. 9, toner T blocking around the regulating portion 30 stagnates on the upstream side of the regulating blade 29 with respect to the rotation direction (in FIG. 9, the counter-clockwise direction) of the developing roller 25 during image formation. To avoid that, the fixed magnet member 27 is rotated in the backward direction (in FIG. 9, the clockwise direction) with respect to the rotation direction of the developing roller 25, and thereby the S2 pole 27*c* is moved inward of the housing 20; this makes it possible to move the toner T stagnating on the upstream side of the regulating blade 29 to inside the housing 20 with the magnetic force of the S2 pole 27*c*.

Next, the fixed magnet member 27 is rotated in the forward direction (in FIG. 8, the counter-clockwise direction), and thereby the S2 pole 27*c* is returned to the first position (see FIG. 4) (step S8). Then, the control portion 90 checks whether or not printing continues (step S9), and if printing continues (step S9, Yes), the flow returns to step S1, where printing is restarted. If printing has been finished (step S9, No), the procedure ends.

Through the control in FIG. 7, the developing device 4 operates in the developer removing mode in which, when no image is formed, the S2 pole 27*c* is moved from the first position to the second position and is then returned to the first position and thus the magnetic force pattern (the intensity and direction of the magnetic field) around the regulating portion 30 varies. As a result, the magnetic force acting between the developing roller 25 or the regulating blade 29 and toner varies, and so does the magnetic force acting among toner particles; this makes the toner stagnating in the regulating portion 30 flow; it is thus possible to prevent toner agglomeration and clogging in the regulating portion 30 resulting from blocking with toner.

Specifically, even when low-melting-point toner with a glass transition point (Tg) of 55° C. or less is used in a developing system in which the developing roller 25 has a liner velocity (process speed) of 500 mm/sec or more and in addition continuous printing is repeated in a high-temperature environment, toner does not stagnate in the regulating portion 30, and blocking with toner resulting from heat or mechanical stress is suppressed. It is thus possible to effectively prevent toner clogging in the regulating portion 30 and the resulting image defects such as white streaks or gray vertical streaks.

If the rotation angle of the S2 pole 27*c* from the first position to the second position is too small, it is impossible to obtain a sufficient effect of making the toner stagnating in the regulating portion 30 flow. On the other hand, if the rotation angle of the S2 pole 27*c* from the first position to the second position is too large, the S1 pole 27*a* and the N1 pole 27*b* of the fixed magnet member 27 also rotate as much, and thus toner carried on the part of the developing roller 25 exposed outside the housing 20 is scattered by movement of the S1 pole 27*a* and the N1 pole 27*b*. The scattered toner attaches to the outer side face (in FIG. 9, the left side face) of the regulating blade 29, the photosensitive drum1, a conveying guide arranged under the developing device 4, and the like, resulting in contamination inside the image forming apparatus 100 and on sheets. It is thus preferable that the rotation angle of the S2 pole 27*c* from the first position to the second position be within a predetermined angle range, and as will be understood from the practical examples presented later, it is preferable that the rotation angle of the S2 pole 27*c* from the first position to the second position be within a range of 15° to 75° , and more preferably within a range of 40° to 75° .

Although, in the example of control in FIG. 7, during execution of the developer removing mode, the operation in which the S2 pole 27*c* is moved from the first position to the second position and is then returned to the first position is performed only once, instead, the operation in which it is moved from the first position to the second position and is then returned to the first position may be performed a plurality of times; it is thus possible to make the toner stagnating in the regulating portion 30 flow more effectively.

Furthermore, it is possible to change, according to the result of detection by the interior temperature and humidity sensor 61, the rotation angle of the S2 pole 27*c* from the first position to the second position during execution of the developer removing mode or the number of times of movement of the S2 pole 27*c* during execution of the same mode or the frequency of execution of the developer removing mode. That is, the higher the interior temperature, the lower the flowability of toner, and thus the more likely blocking and agglomeration are to occur; thus, by increasing the rotation angle of the S2 pole 27*c* from the first position to the second position, increasing the number of times of movement, and increasing the frequency of execution (shortening intervals) of the developer removing mode, it is possible to suppress toner agglomeration and thus to prevent image defects effectively.

Instead of the interior temperature and humidity sensor 61, an exterior temperature sensor that senses the temperature outside (exterior temperature of) the image forming apparatus 100 can be provided, and according to the exterior temperature detected by the exterior temperature sensor, the rotation angle of the S2 pole 27*c* from the first position to the second position during execution of the developer removing mode or the number of times of movement during execution of the same mode or the frequency of execution of the developer removing mode can be changed.

Figure 10:
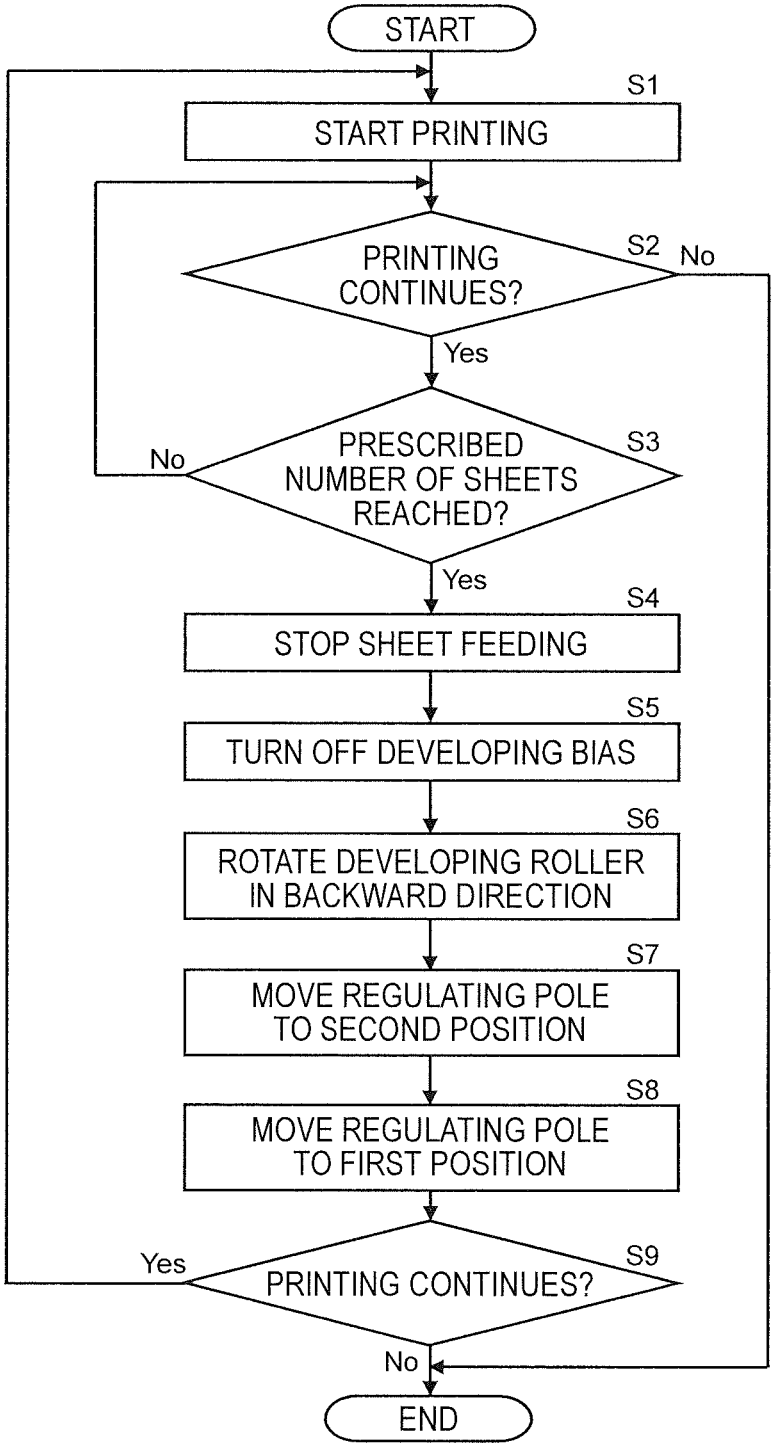
FIG. 10 is a flow chart showing an example of control in the developer removing mode in a developing device according to a second embodiment of the present disclosure.

FIG. 10 is a flow chart showing an example of control in the developer removing mode in the developing device 4 according to a second embodiment of the present disclosure. The developing device 4 has a similar structure as the first embodiment, and therefore no overlapping description will be repeated.

In this embodiment, when the developing device 4 operates in the developer removing mode, the developing roller 25 is rotated in the backward direction through a predetermined angle (step S6), and the S2 pole 27*c* is moved from the first position to the second position (step S7) and is then returned to the first position (step S8). Otherwise, the operation here is similar to that in the first embodiment shown in FIG. 7.

In this embodiment, in addition to variation of the magnetic force pattern around the regulating portion 30 resulting from movement of the S2 pole 27*c* from the first position to the second position, a physical force resulting from rotation of the developing roller 25 in the backward direction acts on the toner stagnating around the regulating portion 30. Thus, compared with the first embodiment, it is easier to make the toner stagnating in the regulating portion 30 flow, and it is thus possible to more effectively prevent toner clogging in the regulating portion 30 and image defects such as white streaks or gray vertical streaks. That is, it is possible to reduce the rotation angle of the S2 pole 27*c*, to reduce the number of times of movement, and to reduce the frequency of execution of the developer removing mode; this makes it possible to improve the efficiency of image formation.

As in the first embodiment, it is possible to change, according to the result of detection by the interior temperature and humidity sensor 61, the rotation angle of the S2 pole 27*c* from the first position to the second position during execution of the developer removing mode or the number of times of movement during execution of the same mode or the frequency of execution of the developer removing mode.

The present disclosure may be implemented in any other manner than in the embodiments described above, and allows for many modification without departure from the spirit of the present disclosure. Although, for example, in the above-described embodiments, the fixed magnet member 27 has four poles including two N poles and two S poles, the present disclosure is applicable equally to a fixed magnet member 27 having five poles or three poles.

Although, the embodiments described above deal with the developing device 4 using magnetic one-component developer, the present disclosure is applicable equally to a developing device using two-component developer containing magnetic carrier and non-magnetic toner. When two-component developer is used, the magnetic force acting between the developing roller 25 or the regulating blade 29 and the magnetic carrier contained in the developer varies, and so does the magnetic force acting among carrier particles vary; this makes the two-component developer stagnating in the regulating portion 30 flow; it is thus possible to prevent toner agglomeration and clogging in the regulating portion 30 resulting from blocking with two-component developer. Below, by way of practical examples, the effects of the present disclosure will be described more specifically.

Practical Examples 1: The relationship between the melting point of toner (Tg), the frequency of execution of the developer removing mode, and the movement angle of the regulating pole (S2 pole 27*c*) with image defects was studied. In the test, a test machine (an altered version of the model FS-4300 manufactured by Kyocera Document Solutions Inc.) was used, and the developing roller 25 was rotates at a liner velocity of 574 mm/sec. Whether and how image defects occurred was inspected visually while the developing device 4 operated in the developer removing mode in which, during continuous printing of 3000 sheets (500 sheets×6 times) in a 33° C. environment, printing was stopped and the S2 pole 27*c* was moved from the first position to the second position and was then returned to the first position for every 100 sheets (30 times), 500 sheets (6 times), and 1000 sheets (3 times).

The movement angle of the regulating pole from the first position to the second position was set at six different levels, namely 0° (no movement), 5°, 15°, 40°, 75°, and 90°. Also, three different types of toner of which the toner resin had a Tg of 45° C., 55° C., and 60° C., respectively, were used.

The criteria for evaluation were as follows: a condition where there was no defect in a toner layer on the developing roller 25 was evaluated as good, a condition where there was unevenness (toner streaks or soil) in a toner layer on the developing roller 25 but there was no image defect was evaluated as fair, and a condition where there was a defect on the output image was evaluated as poor. Table 1 shows the results.

TABLE 1

| MOVEMENT ANGLE OF REGULATING POLE [°] | | 0 | 5 | 15 | 40 | 75 | 90 |
|---|---|---|---|---|---|---|---|
| TONE RESIN Tg 45° C. | EVERY 100 SHEETS | — | POOR (WHITE STREAKS) | FAIR (TONER STREAKS) | GOOD | GOOD | FAIR (SOIL) |
| | EVERY 500 SHEETS | — | POOR (WHITE STREAKS) | FAIR (TONER STREAKS) | FAIR (TONER STREAKS) | GOOD | FAIR (SOIL) |
| | EVERY 1000 SHEETS | — | POOR (WHITE STREAKS) | FAIR (TONER STREAKS) | FAIR (TONER STREAKS) | GOOD | FAIR (SOIL) |
| | NO MOVEMENT | POOR (WHITE STREAKS) | — | — | — | — | — |
| TONE RESIN Tg 45° C. | EVERY 100 SHEETS | — | FAIR (TONER STREAKS) | GOOD | GOOD | GOOD | FAIR (SOIL) |
| | EVERY 500 SHEETS | — | FAIR (TONER STREAKS) | FAIR (TONER STREAKS) | GOOD | GOOD | FAIR (SOIL) |
| | EVERY 1000 SHEETS | — | FAIR (TONER STREAKS) | FAIR (TONER STREAKS) | FAIR (TONER STREAKS) | GOOD | FAIR (SOIL) |
| | NO MOVEMENT | POOR (WHITE STREAKS) | — | — | — | — | — |
| TONE RESIN Tg 45° C. | EVERY 100 SHEETS | — | FAIR (TONER STREAKS) | GOOD | GOOD | GOOD | FAIR (SOIL) |
| | EVERY 500 SHEETS | — | FAIR (TONER STREAKS) | GOOD | GOOD | GOOD | FAIR (SOIL) |
| | EVERY 1000 SHEETS | — | FAIR (TONER STREAKS) | FAIR (TONER STREAKS) | GOOD | GOOD | FAIR (SOIL) |
| | NO MOVEMENT | FAIR (TONER STREAKS) | — | | | — | — |

The test results were as follows. In a case where toner of which the toner resin had a Tg of 45° C. was used, when the movement angle of the regulating pole was set at 0° (no movement) and 5° in the developer removing mode, white streaks appeared in the image. When the movement angle was set at 15°, toner streaks appeared on the developing roller 25 but no white streaks appeared on the image. Then, when the movement angle was set at 45° and the frequency of execution of the developer removing mode was set for every 100 sheets, or when the movement angle was set at 75°, no toner streaks appeared on the developing roller 25 either any longer. These results indicate that, by increasing the movement angle of the regulating pole in the developer removing mode and the frequency of execution of the developer removing mode, it is possible to prevent the appearance of white streaks in the image and toner streaks on the developing roller 25.

However, when the movement angle was set at 90°, toner attracted by the magnetic force acting in the backward direction with respect to the rotation direction of the developing roller 25 during printing soiled the surface of the regulating blade 29 among others. Although no image defect was observed during continuous printing of 3000 sheets, it is feared that, as printing continues, soil may accumulate and this may lead to image defects. Thus, the movement angle of the regulating pole is considered to need to be within a predetermined angle range (15° to 75°) and is preferably within a range of 40° to 75°.

Also indicated is the following. With the toner of which the toner resin had a Tg of 55° C. or 60° C., the appearance of white streaks on the image and of toner streaks tended to reduce; compared with the toner of which the toner resin had a Tg of 55° C. or 60° C., the toner of which the toner resin had a Tg of 45° C. provided a greater effect of changing the angle of the regulating pole. Thus, it is considered that toner with lower thermal characteristics (toner of which the toner resin has a Tg of 55° C. or less) suitable for energy saving provides a greater effect of preventing blocking with toner through execution of the developer removing mode in which the regulating pole is moved.

Practical Examples 2: In the test, except than that the developing roller 25 was rotated through 45° in the backward direction during execution of the developer removing mode, the methods and the criteria for evaluation here were similar to those in Practical Example 1. Table 2 shows the results.

TABLE 2

| MOVEMENT ANGLE OF REGULATING POLE [°] | | 0 | 5 | 15 | 40 | 75 | 90 |
|---|---|---|---|---|---|---|---|
| TONE RESIN Tg 45° C. | EVERY 100 SHEETS | — | FAIR (TONER STREAKS) | GOOD | GOOD | GOOD | FAIR (SOIL) |

TABLE 2-continued

| MOVEMENT ANGLE OF REGULATING POLE [°] | | 0 | 5 | 15 | 40 | 75 | 90 |
|---|---|---|---|---|---|---|---|
| | EVERY 500 SHEETS | — | FAIR (TONER STREAKS) | GOOD | GOOD | GOOD | FAIR (SOIL) |
| | EVERY 1000 SHEETS | — | POOR (WHITE STREAKS) | FAIR (TONER STREAKS) | GOOD | GOOD | FAIR (SOIL) |
| | NO MOVEMENT | POOR (WHITE STREAKS) | — | — | — | — | — |
| TONE RESIN Tg 45° C. | EVERY 100 SHEETS | — | FAIR (TONER STREAKS) | GOOD | GOOD | GOOD | FAIR (SOIL) |
| | EVERY 500 SHEETS | — | FAIR (TONER STREAKS) | GOOD | GOOD | GOOD | FAIR (SOIL) |
| | EVERY 1000 SHEETS | — | FAIR (TONER STREAKS) | GOOD | GOOD | GOOD | FAIR (SOIL) |
| | NO MOVEMENT | POOR (WHITE STREAKS) | — | — | — | — | — |
| TONE RESIN Tg 45° C. | EVERY 100 SHEETS | — | GOOD | GOOD | GOOD | GOOD | FAIR (SOIL) |
| | EVERY 500 SHEETS | — | GOOD | GOOD | GOOD | GOOD | FAIR (SOIL) |
| | EVERY 1000 SHEETS | — | FAIR (TONER STREAKS) | GOOD | GOOD | GOOD | FAIR (SOIL) |
| | NO MOVEMENT | FAIR (TONER STREAKS) | — | | | — | — |

The test results were as follows. In a case where the developing roller 25 was rotated in the backward direction during execution of the developer removing mode, with toner of which the toner resin had a Tg of 45° C., when the movement angle of the regulating pole was set at 5° and the frequency of execution of the developer removing mode was set for every 500 sheets or less, no white streaks appeared on the image any longer. Also, when the movement angle was set at 15° and the frequency of execution of the developer removing mode was set for every 500 sheets or less, no toner streaks appeared on the developing roller 25.

That is, by rotating the developing roller 25 in the backward direction during execution of the developer removing mode, compared with a case where the developing roller 25 was not rotated in the backward direction, a satisfactory effect of preventing white streaks in the image and toner streaks on the developing roller 25 was obtained. These results indicate that, by both rotating the developing roller 25 in the backward direction and changing the angle of the regulating pole in the developer removing mode, it is possible to more effectively prevent blocking with toner.

The present disclosure is applicable to a developing device that uses magnetic developer. Based on the present disclosure, it is possible to provide a developing device that can prevent developer clogging in a regulating portion even when continuous printing is performed in a high-temperature environment, and to provide an image forming apparatus incorporating such a developing device.

What is claimed is:

1. A developing device comprising:

a housing that stores magnetic developer;

a developer carrying member that is rotatably supported on the housing, the developer carrying member carrying the developer on a circumferential face;

a regulating blade that is formed of a magnetic material, the regulating blade being arranged at a predetermined interval from the developer carrying member, the regulating blade forming a regulating portion that regulates a thickness of the developer carried on the developer carrying member; and a magnet member that is arranged inside the developer carrying member, the magnet member having a plurality of magnetic poles including a regulating pole arranged at a position where the developer carrying member and the regulating blade are close together, the developing device developing an electrostatic latent image formed on an image carrying member, wherein the regulating pole is movable to a first position that faces the regulating portion and to a second position rotated to an upstream side through a predetermined angle from the first position with respect to a rotation direction of the developer carrying member during image formation, and the developing device is operable in a developer removing mode in which, when no image is formed, the regulating pole is moved from the first position to the second position and is then returned to the first position to remove the developer stagnating in the regulating portion.

2. The developing device according to claim 1, wherein a rotation angle of the regulating pole from the first position to the second position is within a range of 15° to 75°.

3. The developing device according to claim 2, wherein the rotation angle of the regulating pole from the first position to the second position is within a range of 40° to 75°.

4. The developing device according to claim 1, wherein during execution of the developer removing mode, the developer carrying member is rotated through a predetermined angle in a backward direction with respect to a direction in which the developer carrying member is rotated during image formation.

5. The developing device according to claim 1, wherein during execution of the developer removing mode, the operation in which the regulating pole is moved from the first position to the second position and is then returned to the first position is performed a plurality of times.

6. The developing device according to claim 1, wherein when a cumulative number of printed sheets counted after previous execution of the developer removing mode has reached a prescribed number of sheets, the developing device operates in the developer removing mode.

7. The developing device according to claim 1, wherein toner resin that is included in toner contained in the developer has a glass transition point of 55° C. or less.

8. The developing device according to claim 1, wherein a rotation speed of the developer carrying member during image formation is 500 mm/sec or more.

9. The developing device according to claim 1, wherein the developer is magnetic one-component developer containing magnetic toner alone.

10. An image forming apparatus comprising:

the developer device according to claim 1.

11. The image forming apparatus according to claim 10 further comprising:

a temperature sensing device that senses a temperature inside or outside the image forming apparatus; and a control portion that controls the developing device, wherein the control portion changes, based on a result of detection by the temperature sensing device, at least one of a rotation angle of the regulating pole from the first position to the second position and a number of times of movement of the regulating pole in the developer removing mode and a frequency of execution of the developer removing mode.

* * * * *